US007208693B1

(12) United States Patent
Yu

(10) Patent No.: US 7,208,693 B1
(45) Date of Patent: Apr. 24, 2007

(54) SAFETY DEVICE FOR DUAL-CIRCUIT SWITCH

(76) Inventor: Tsung Mou Yu, No. 4, Alley 2, Lane 23, Sec. 3, Pa Te Road, Panchiao,Taipei (TW)

( * ) Notice: Subject to any disclaimer, the term of this patent is extended or adjusted under 35 U.S.C. 154(b) by 0 days.

(21) Appl. No.: 11/322,065

(22) Filed: Dec. 29, 2005

(51) Int. Cl.
*H01H 21/00* (2006.01)

(52) U.S. Cl. ..... 200/553; 200/557; 200/339; 200/18

(58) Field of Classification Search ..... 200/553
See application file for complete search history.

(56) References Cited

U.S. PATENT DOCUMENTS 6,448,880 B2 * 9/2002 Yu ..... 337/66
6,664,884 B1 * 12/2003 Yu ..... 337/59
6,753,491 B1 * 6/2004 Huang ..... 200/400
6,822,179 B1 * 11/2004 Huang ..... 200/401
7,116,207 B1 * 10/2006 Yu ..... 337/59

* cited by examiner

*Primary Examiner*—K. Lee
*Assistant Examiner*—Lheiren Mae A. Anglo

(57) ABSTRACT

A switch includes a body with a switch member and two springs are connected to an underside of the switch member. Two identical circuit assemblies are isolated from each other and received in the body. Each circuit assembly has two terminals and a bimetallic plate has a first end connected to the first terminal and the bi-metallic plate can be deformed when the switch is overloaded to separate two contact points to cut off the circuit. A carry member is connected to the two respective bi-metallic plates of the two circuit assemblies so that when either one of the two bi-metallic plates is deformed, the carry member is moved to separate the two contact points of the other circuit assembly and cut off the two circuit assemblies simultaneously when the switch is overloaded.

10 Claims, 7 Drawing Sheets

(OFF)

(ON)

SAFETY DEVICE FOR DUAL-CIRCUIT SWITCH

BACKGROUND OF THE INVENTION

1. Field of the Invention

The present invention relates generally to a safety device for simultaneously cut off the circuits of a dual-circuit switch when it is overload.

2. The Prior Arts

A conventional switch used in Europe includes two circuits and each of which provides current to the switch. When the switch is overloaded, if one of the two circuits jumps off, the other circuit still works normally. There are several shortcomings for this type of switches. One is that if the overload problem is not removed in time, the circuit that works normally cannot provide sufficient current to the appliance which might not be able to function as desired. Because there is one circuit works, users are not aware of the situation of the switch and potential risks of burning due to overload might happen. Besides, when inspecting the switch or the circuit, if the inspector forgets to cut off the circuit that still functions, electric hazard to the inspector might happen. Therefore, a safety device for simultaneously cutting off the two circuits when the switch is overloaded is necessary.

SUMMARY OF THE INVENTION

A primary objective of the present invention is to provide a safety device for a dual-circuit switch wherein the safety device includes a carry member and two bi-metallic plates of the two circuits are connected to the carry member. When either of the two bi-metallic plates is deformed due to overload, the carry member is moved by the deformation of the bi-metallic plate so that the other bi-metallic plate is bent in the same direction so as to simultaneously cut off the two circuits.

Another objective of the present invention is to provide a safety device for a dual-circuit switch wherein the safety device includes two biasing members which are U-shaped members and has one end thereof connected with a distal end of each of the two bi-metallic plates so that when one of the bi-metallic plates is deformed because of overload, the biasing member ensures the deformed bi-metallic plate to be maintained at the position and does not bounce back.

A further objective of the present invention is to provide a safety device for a dual-circuit switch wherein the safety device includes two adjusting bolts which are respectively connected to two respective other ends of the biasing members whose curvature can be adjusted by operating the adjusting bolts to ensure that the deformed bi-metallic plate is maintained at that position by the biasing member.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
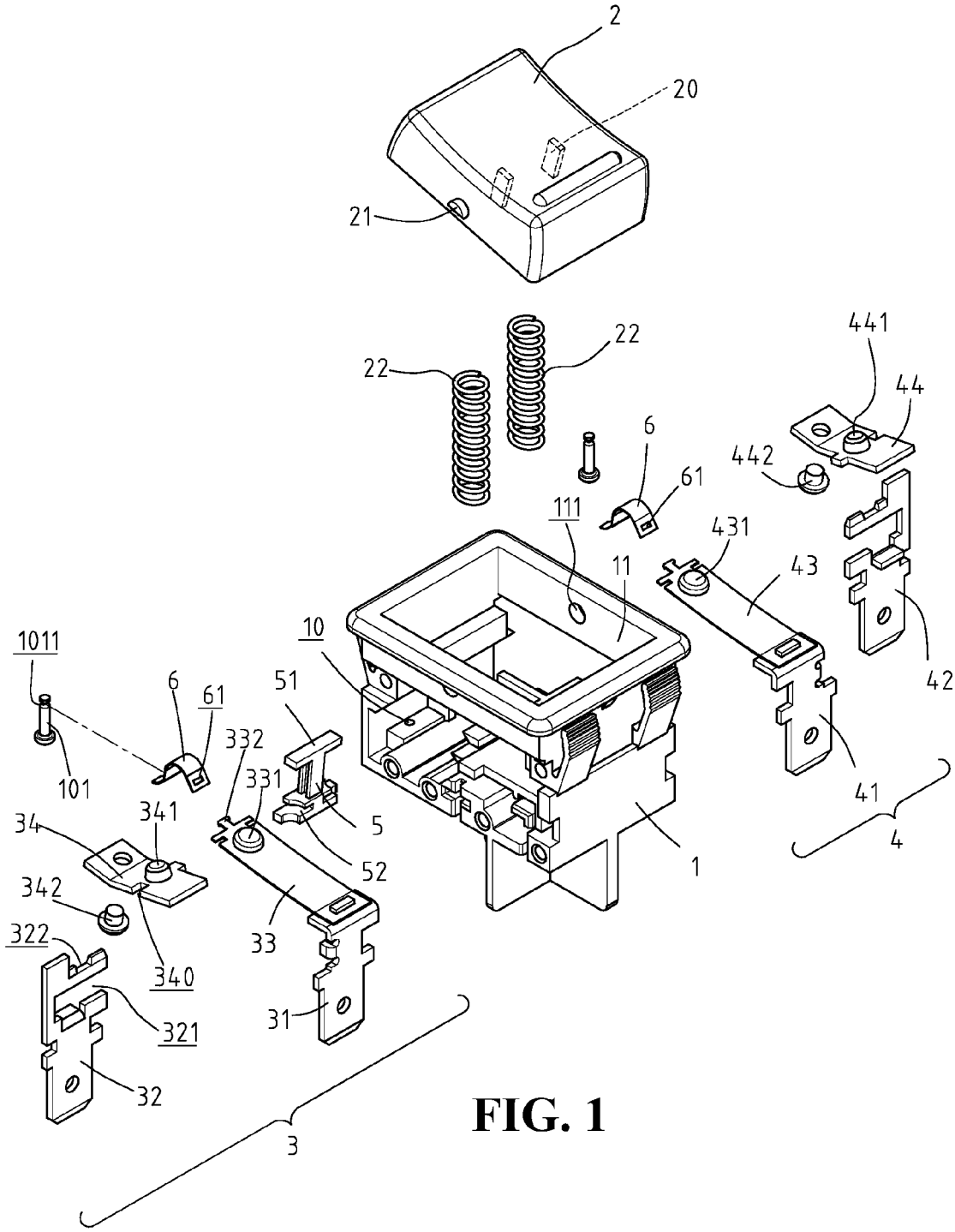
FIG. 1 is an exploded view to show the safety device and the switch in accordance with the present invention.

With reference to the drawings and in particular to FIG. 1, a dual-circuit switch with a safety device of the present invention comprises a body 1 having an open top 11 and two holes 111 are defined through two opposite walls of the body 1. A switch member 2 is engaged with the open top 11 of the body 1 and has two shafts 21 on two sides thereof. The two shafts 21 are engaged with the two holes 111 so that the switch member 2 can be pivotable about the two shafts 21. The switch member 2 further has two protrusions 20 extending from the underside thereof and two springs 22 which are compressible springs are connected with the two protrusions 20.

Two identical circuit assemblies 3, 4 are isolated from each other and received in the body 1. Each circuit assembly 3/4 has a first terminal 31/41 and a second terminal 32/42. A bimetallic plate 33/43 has a first end connected to the first terminal 31/41 and a first contact point 331/431 is connected to the other end of the bi-metallic plate 33/43. The second terminal 32/42 has a side slot 321 defined in a side thereof and an engaging recess 322 is defined in a top of each of the second terminal 32/42. A pivotable member 34/44 is pivotably connected to the second terminal 32 of each of the two circuit assemblies 3, 4 and one of the springs 22 is connected to a boss 341/441 on the pivotable member 34/44. Each of the pivotable members 34, 44 has a notch 340 defined in a side thereof, the pivotable member 34/44 is engaged with the engaging recess 322 and a part of the second terminal 32 is engaged with the notch 340 so that the pivotable member 34/44 is pivotable relative to the second terminal 32/42. A second contact point 342/442 is connected to the pivotable member 34/44 and located corresponding to the first contact point 331. The bi-metallic plate 33/43 is received in the side slot 321 of the second terminal 32/42 and is not in contact with the second terminal 32/42.

Figure 5:
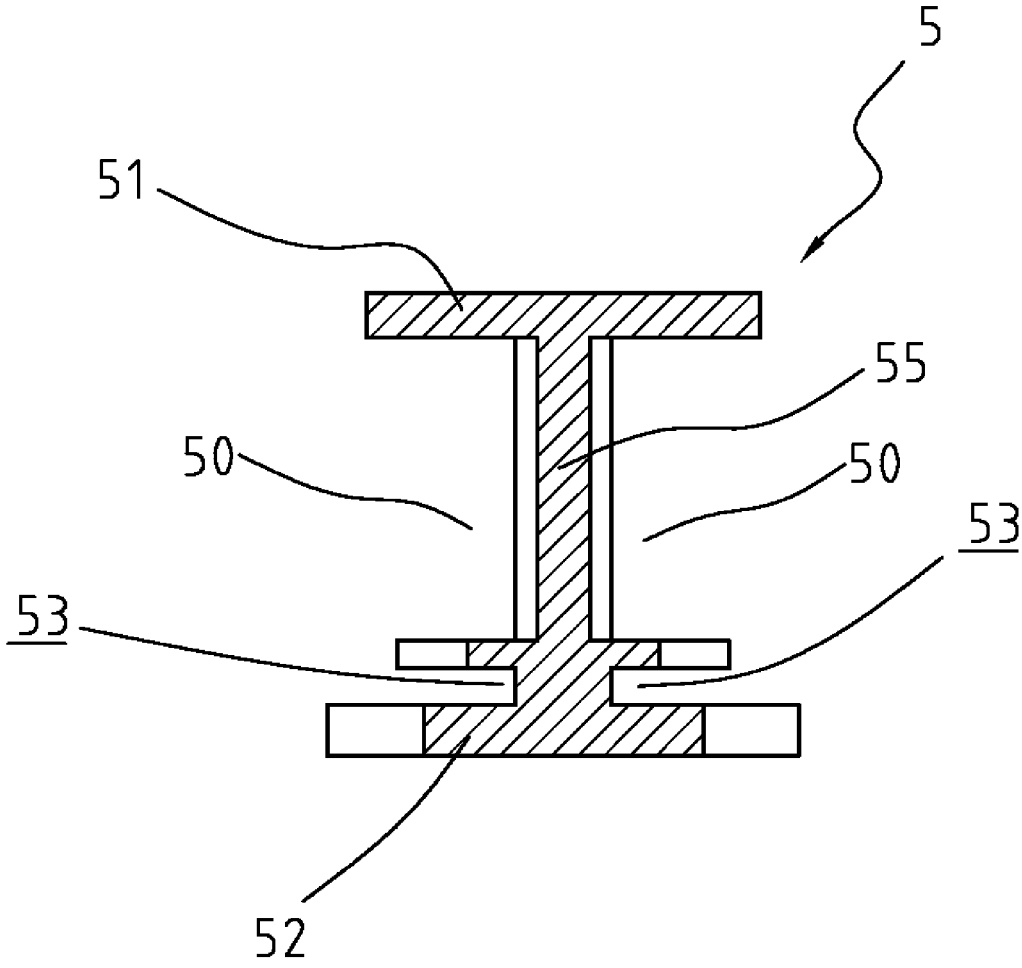
FIG. 5 is a cross sectional view to show the carry member of the safety device of the present invention.
Figure 6A:
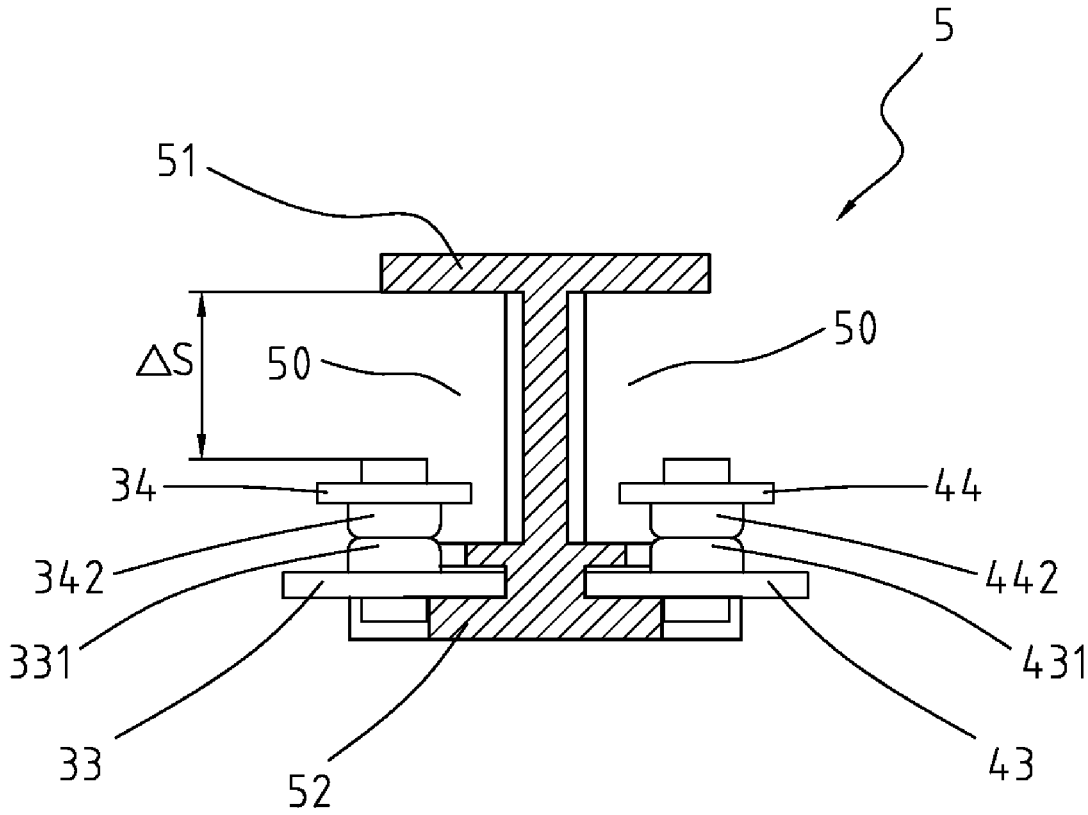
FIG. 6*a* shows there is a gap between the top bar and the bottom bar of the carry member so that the contact point on the pivotable member is movable within the gap.
Figure 6B:
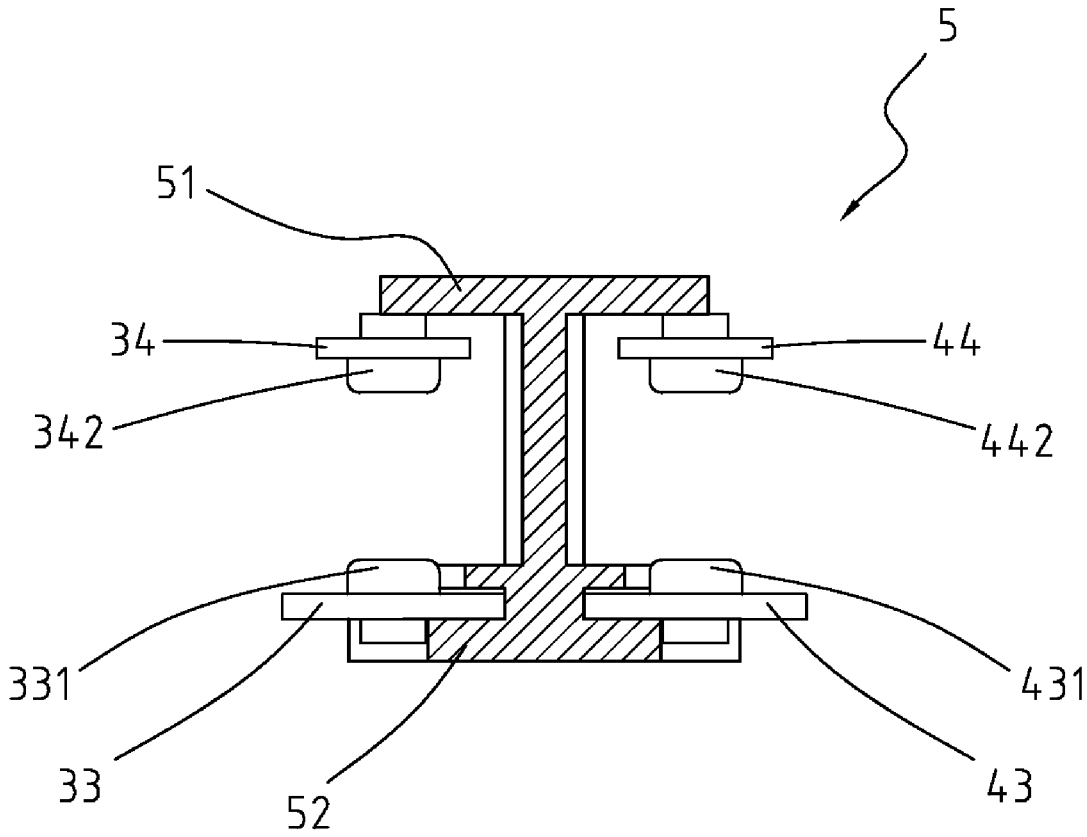
FIG. 6*b* shows that the contact point on the pivotable member is movable away from the contact point on the bi-metallic plate.

As shown in FIGS. 5, 6*a* and 6*b*, a carry member 5 includes a top bar 51, a bottom bar 52 and a link 55 connected between the top and bottom bars 51, 52. Two slots 53 are defined in two sides of the carry member 5 and the two bi-metallic plates 33, 43 are engaged with the two slots 53. The second contact points 342, 442 of the two pivotable members 34, 44 are movably located between two gaps 50 formed on the two sides of the link 55 between the top and bottom bars 51, 52. The second contact point 342/442 can be moved within the gap Δs. The carry member 5 is made by isolation material so that the two bi-metallic plates 33, 43 are electrically isolated from each other.

Two passages 10 are defined in the body 1 and two adjusting bolts 101 extend through the two passages 10. A tongue 332 extends from a second end of each of the bi-metallic plates 33, 43, and two U-shaped biasing members 6 each have a first end connected to an adjusting bolt 101 corresponding thereto and a second end of each of the biasing members 6 has an aperture 61 with which the tongue 332 is engaged. Each of the adjusting bolts 101 includes a groove 1011 and the first end of each of the biasing members 6 is engaged with the groove 1011.

Figure 2:
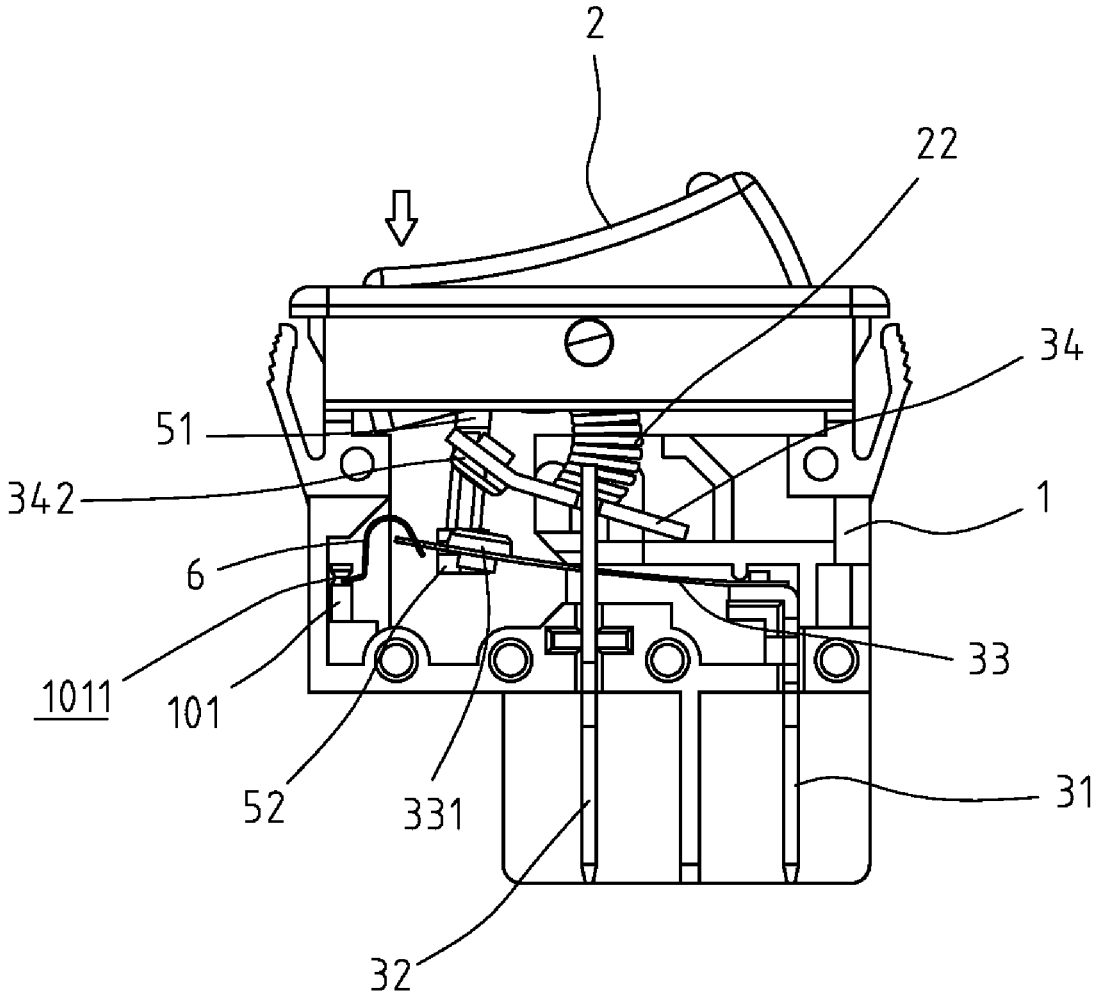
FIG. 2 is a side view to show that the switch is in "OFF" position.
Figure 3:
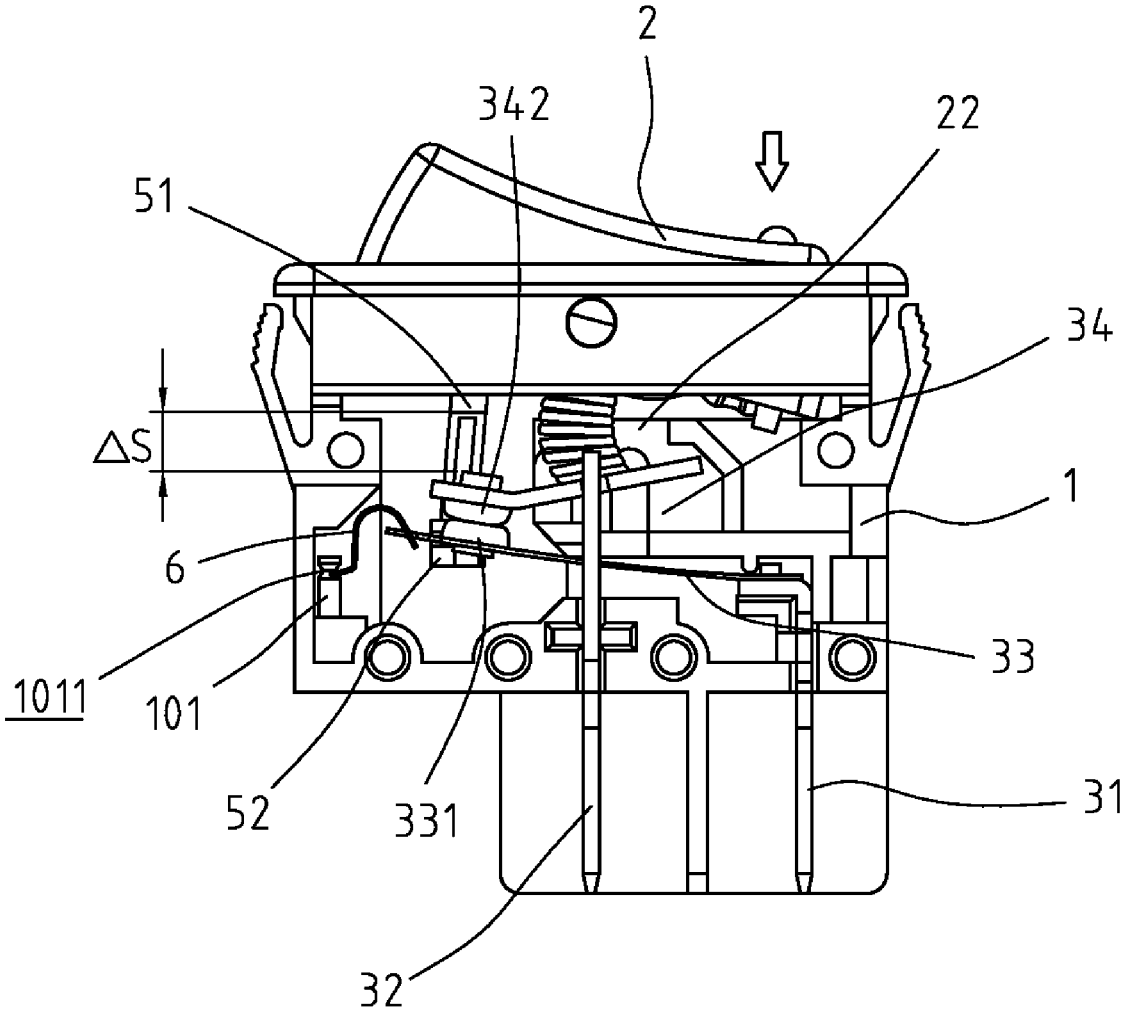
FIG. 3 is side view to show that the switch is in "ON" position.

As shown in FIG. 2, when the left end of the switch member 2 is pushed downward, the springs 22 are compressed and bent toward right so that the right end of the pivotable member 34/44 is lowered and the left end on which the second contact point 342/442 is located is lifted. In this position, the first and second contact points 331/431 and 342/442 are separated, so that the circuit assemblies are in "OFF" status. As shown in FIG. 3, when the right end of the switch member 2 is pushed downward, the springs 22 are compressed and bent toward left so that the left end of the pivotable member 34/44 is lowered and the second contact point 342/442 is lowered to contact with the first contact point 331/431, so that the circuit assemblies are in "ON" status.

Figure 4:
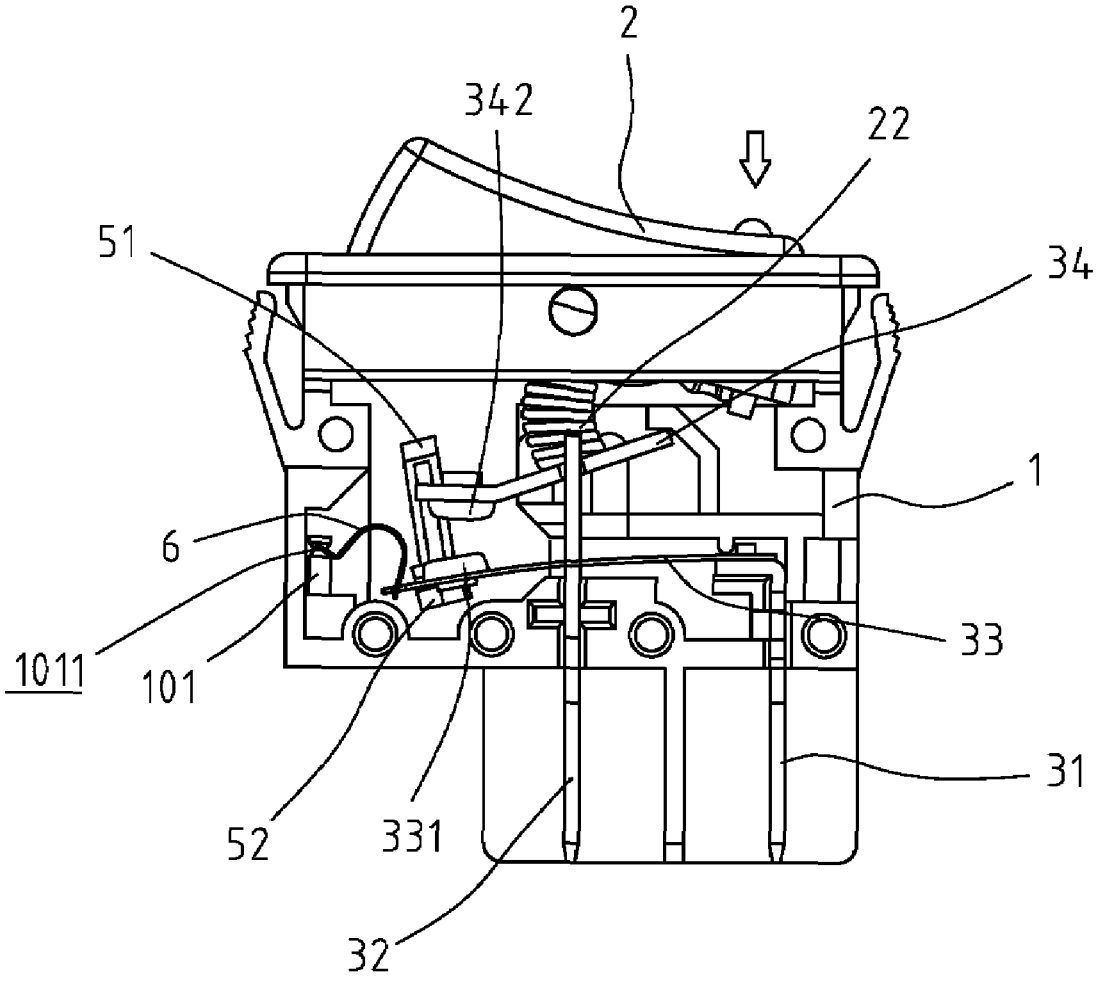
FIG. 4 shows that the bi-metallic plate is deformed because of overload.

As shown in FIG. 4, when the switch is overloaded, one of the two bimetallic plates 33 or 43 is deformed downward and drives the carry member 5 downward to separate the first and second contact points 331/431 and 342/442 to cut off the two circuit assemblies 3, 4 simultaneously. The downward deformation of the bi-metallic plate 33 or 43 bends the U-shaped biasing member 6 and the second end of the biasing member 6 pushes the bi-metallic plate 33/43 to keep the deformed position, so that the bi-metallic plates 33, 43 do not bounce backward.

The adjusting bolts 101 can be rotated upward or downward by using a screwdriver to adjust the curvature of the U-shaped biasing members 6 to ensure that the two bi-metallic plate 33 or 43 can be maintained at its deformed position when the switch is overloaded. After the user removes the cause of the overload and pushes the left end of the switch member 2 downward, the pivotable members 34, 44 are then pivoted to lift the carry member 5 upward to set the switch to "OFF" position. The carry member 5 then lifts the deformed bi-metallic plate 33/43 to its normal "OFF" position as shown in FIG. 2.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A switch comprising:

a body having an open top;

a switch member pivotably engaged with the open top of the body and two springs connected to an underside of the switch member;

two identical circuit assemblies isolated from each other and received in the body, each circuit assembly having a first terminal and a second terminal, a bimetallic plate having a first end connected to the first terminal and a first contact point connected to a second end of the bi-metallic plate, a pivotable member pivotably connected to the second terminal and one of the springs connected to the pivotable member, and a second contact point connected to the pivotable member and located corresponding to the first contact point; and a carry member connected to the two respective bi-metallic plates of the two circuit assemblies, the carry member having a gap formed for each of the two pivotal members so that the second contact point of the respective pivotable member is moved within the respective gap;

wherein a second end of each of the bi-metallic plates is connected to a biasing member which is connected to the body.

2. The switch as claimed in claim 1, wherein the carry member includes a top bar, a bottom bar and a link connected between the top and bottom bars, two slots are defined in two sides of the carry member and the two bi-metallic plates are engaged with the two slots, the two pivotable members movably located between the top and bottom bars.

3. The switch as claimed in claim 1, wherein the carry member and the two bi-metallic plates are electrically isolated from each other.

4. The switch as claimed in claim 1, wherein the switch member has two protrusions extending from the underside thereof and the two springs are connected with the two protrusions.

5. The switch as claimed in claim 1, wherein the springs are compressible springs.

6. The switch as claimed in claim 1, wherein two holes are defined through two opposite walls of the body and the switch member includes two shafts on two sides thereof so that the two shafts are engaged with the two holes.

7. The switch as claimed in claim 1, wherein the second terminal of each of the two circuit assemblies has a side slot defined in a side thereof and an engaging recess defined in a top of each of the second terminals, each of the pivotable members has a notch defined in a side thereof, the pivotable member engaged with the engaging recess and a part of the second terminal is engaged with the notch so that the pivotable member is pivotable relative to the second terminal.

8. The switch as claimed in claim 7, wherein the bi-metallic plate is received in the side slot of the second terminal and is not in contact with the second terminal.

9. A switch comprising:

a body having an open top;

a switch member pivotably engaged with the open top of the body and two springs connected to an underside of the switch member;

two identical circuit assemblies isolated from each other and received in the body, each circuit assembly having a first terminal and a second terminal, a bimetallic plate having a first end connected to the first terminal and a first contact point connected to a second end of the bi-metallic plate, a pivotable member pivotably connected to the second terminal and one of the springs connected to the pivotable member, and a second contact point connected to the pivotable member and located corresponding to the first contact point; and a carry member connected to the two respective bi-metallic plates of the two circuit assemblies, the carry member having a gap formed for each of the two pivotal members so that the second contact point of the respective pivotable member is moved within the respective gap;

wherein two passages are defined in the body and two adjusting bolts extend through the two passages, a tongue extends from a second end of each of the bi-metallic plates, two U-shaped biasing members each have a first end connected to the adjusting bolt corresponding thereto and a second end of each of the biasing members has an aperture with which the tongue is engaged.

10. The switch as claimed in claim 9, wherein each of the adjusting bolts includes a groove and the first end of each of the biasing members is engaged with the groove.

* * * * *